US007105757B2

(12) United States Patent
Valentini

(10) Patent No.: US 7,105,757 B2
(45) Date of Patent: Sep. 12, 2006

(54) MAGNETIC FLOW SWITCH, FOR ASPIRATORS IN PARTICULAR

(75) Inventor: Guido Valentini, Milan (IT)

(73) Assignee: R.U.P.E.S. Realizzazione Utensili Pneumatici Elettrici Speciali SpA, Vermezzo (IT)

( * ) Notice: Subject to any disclaimer, the term of this patent is extended or adjusted under 35 U.S.C. 154(b) by 0 days.

(21) Appl. No.: 11/316,309

(22) Filed: Dec. 21, 2005

(65) Prior Publication Data

US 2006/0141912 A1 Jun. 29, 2006

(30) Foreign Application Priority Data

Dec. 24, 2004 (IT) ..... MI2004A2507

(51) Int. Cl.
*H01H 35/40* (2006.01)

(52) U.S. Cl. ..... 200/81.9 M; 335/205

(58) Field of Classification Search ..... 200/81 R, 200/81.8, 81.9 R, 81.9 M, 82 R, 82 D, 82 E; 335/205–207

See application file for complete search history.

(56) References Cited

U.S. PATENT DOCUMENTS 4,181,835 A * 1/1980 Stadler et al. ..... 200/82 E
4,377,090 A * 3/1983 Seulen ..... 73/861.74
4,739,135 A 4/1988 Custer
4,996,396 A * 2/1991 Smith ..... 200/81.9 M
5,070,220 A * 12/1991 Glenn ..... 200/81.9 M
5,478,977 A * 12/1995 Beasley ..... 200/82 E
6,344,782 B1 * 2/2002 Yang ..... 335/205
6,472,624 B1 * 10/2002 Harris et al. ..... 200/81.9 R

FOREIGN PATENT DOCUMENTS

EP 0299676 1/1989
FR 2718234 10/1995

* cited by examiner

*Primary Examiner*—Michael A. Friedhofer
(74) *Attorney, Agent, or Firm*—Sheridan Ross P.C.

(57) ABSTRACT

A magnetic flow switch (1) is described that includes a body (2) defining a chamber (20) destined to have a fluid flow pass through it, an excitation magnet (4) placed in a shuttle (3) mounted such that it can slide within the chamber (20) of the body to pass from an initial front position to a final rear position, a Reed switch (6) arranged on the body (2) of the flow switch to detect the magnetic field generated by the displacement of the excitation magnet (4) and to accordingly send a control signal to an electronic control board, and at least one attraction magnet (7) arranged on the body (2) of the flow switch, in a position such as to generate an attraction magnetic field able to attract the excitation magnet (4) to make the shuttle (3) move to the initial front position.

17 Claims, 5 Drawing Sheets

Figure 1:
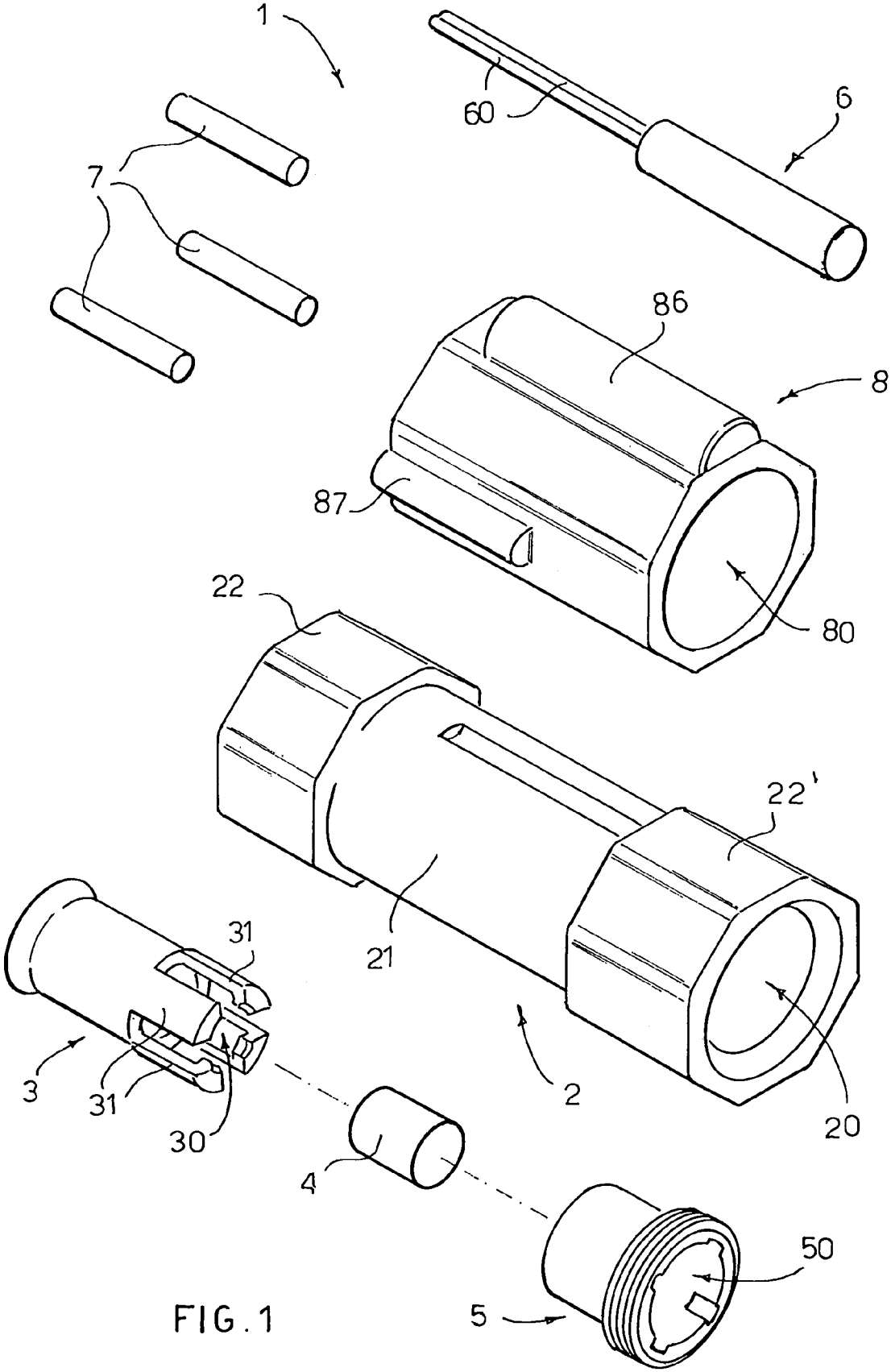

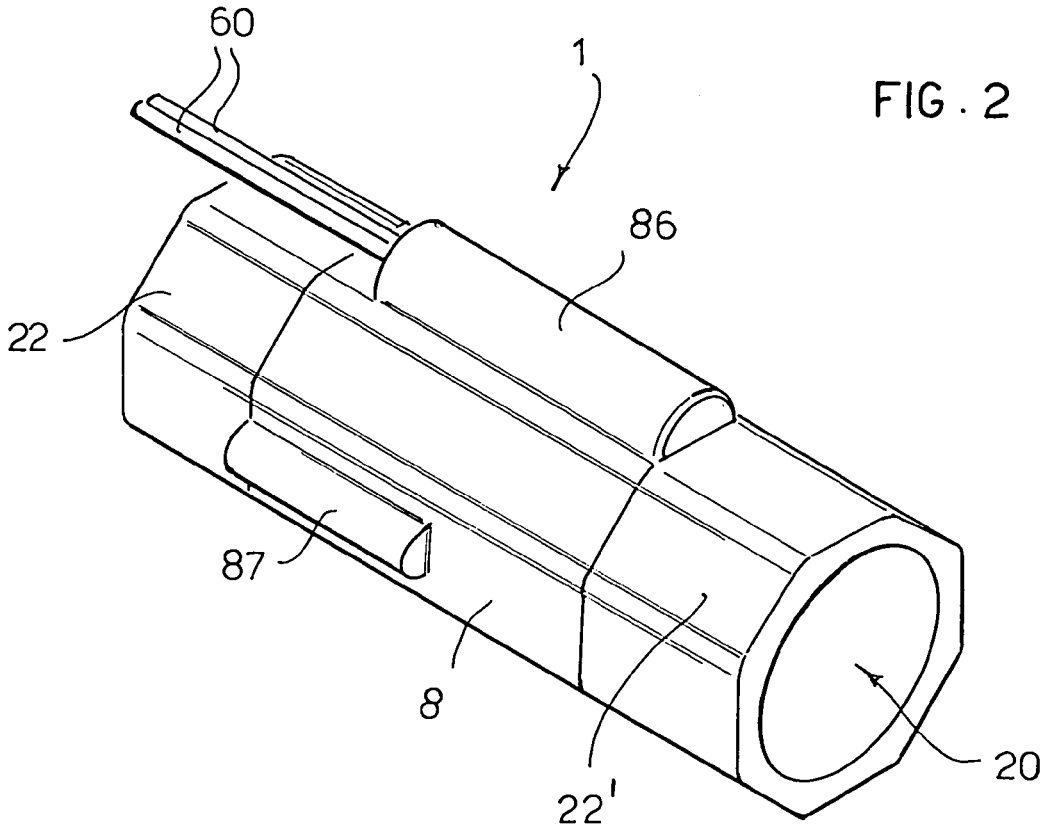
FIG. 2
FIG. 3
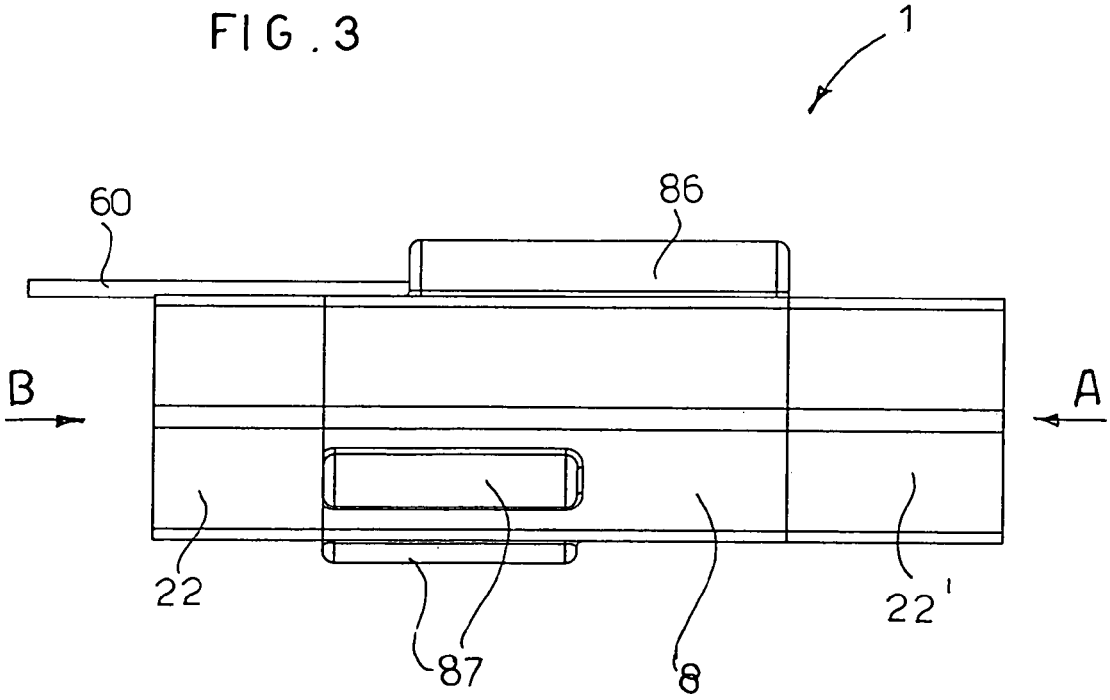

MAGNETIC FLOW SWITCH, FOR ASPIRATORS IN PARTICULAR

CROSS REFERENCE TO RELATED APPLICATIONS

This application claims the benefit of Italian Application No. MI2004A 002507, filed Dec. 24, 2005, the entire disclosure of which is hereby incorporated herein by reference.

DESCRIPTION

This invention refers to magnetic flow switch, particularly suited for application to an aspirator to allow its automatic starting, when activated by a pneumatic machine, such as a grinding machine for example, connected to the aspirator.

Pneumatic grinding machines that are connected via a suction pipe to an aspirator equipped with a suction turbine for sucking the dust generated by the grinding process are commonplace on the market. There are known valve switches, commonly called flow switches, for controlling the switching on and hence the suction of the aspirator.

The flow switch is able to sense the flow of a fluid passing through its valve body and, accordingly, to send an electrical control signal to control the switching on of the aspirator. To this end, a flow switch includes a magnet that is mounted inside its body in a manner such that it is free to slide. The magnet is moved by the flow of fluid that runs through the body of the flow switch. The displacement of the magnet generates a magnetic field that excites a magnetic contact switch (Reed switch). The Reed switch accordingly sends a control signal to an electronic circuit board for controlling the switching on of the aspirator.

These types of flow switches are normally of the inertial type and must be arranged in a vertical position so that when the fluid feed flow is interrupted, the magnet can fall back to its initial position under the effect of gravity, thus making the flow switch ready for switching on the aspirator again. It is clear that such a flow switch cannot function in a horizontal position, because the magnet would not return under gravity to the initial position when the fluid feed flow is interrupted.

As a result, such flow switches are not suitable for utilization in aspirators that can be located in positions other than the vertical one, such as portable aspirators for example, which are moved according to the needs of the user.

To at least partially resolve this drawback, other types of commercially available flow switches are known of that provide a traction spring connected to the magnet and located in the flow switch's fluid passage chamber. When the fluid flow is interrupted, this traction spring returns the magnet to the initial position, so as to prepare the flow switch for another switching on operation.

Nevertheless, it must be considered that the flow of fluid passing through the flow switch's chamber, especially in the case of aspirators, can introduce impurities that tend to impede spring operation, also with the risk of its deterioration and wear.

The object of this invention is to eliminate the drawbacks of known technology, providing a magnetic flow switch, for aspirators in particular, which is extremely reliable and, at the same time, has a long mean working life.

Another object of this same invention is to provide a flow switch that is extremely versatile and suitable for utilization in any position.

Another object of this invention is to provide a flow switch that is both economic and easy to manufacture.

These objects are achieved in accordance with the invention with the characteristics listed in the attached independent claim 1.

Advantageous embodiments of the invention appear in the dependent claims.

The magnetic flow switch in accordance with the invention includes:

- a body defining a substantially cylindrical axial through chamber, destined to have a fluid flow pass through it,
- an excitation magnet located in a shuttle mounted such that it can slide within said chamber of the body to pass from an initial front position to a final rear position, under the action of the pressure of the fluid flow passing through the chamber of the flow switch, and
- a magnetic contact switch or Reed switch arranged on the body of the flow switch to detect the magnetic field generated by the displacement of said excitation magnet from the front position to the rear position and accordingly send a control signal to an electronic control board.

The main characteristic of the invention is represented by the fact that the flow switch also includes at least one attraction magnet, arranged on the body of the flow switch in a position such as to generate an attraction magnetic field suitable for attracting said excitation magnet to make the shuttle move to the initial front position when the fluid flow in interrupted, irrespective of the position in which the flow switch is situated.

The advantages of a flow switch in accordance with this invention, which can be arranged in any position, are evident. In fact, when the fluid flow in interrupted, the return of the shuttle to the initial position is assured by the field of magnetic attraction generated by said at least one attraction magnet.

In addition, the attraction magnet is positioned outside the chamber of the flow switch's body and therefore not in contact with the fluid flow. This guarantees a longer life and less wear on the attraction magnet.

Figure 4:
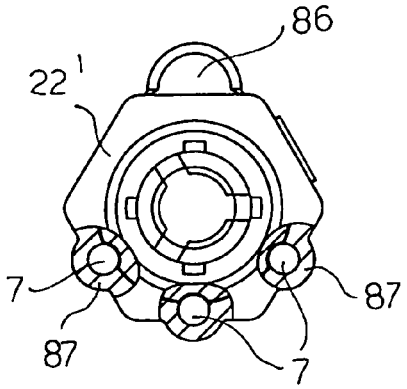
Figure 5:
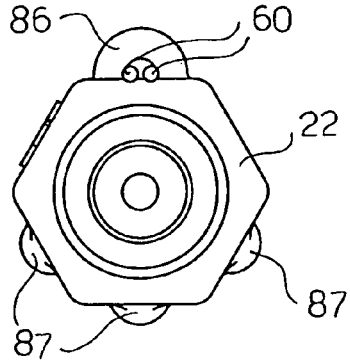
Figure 6:
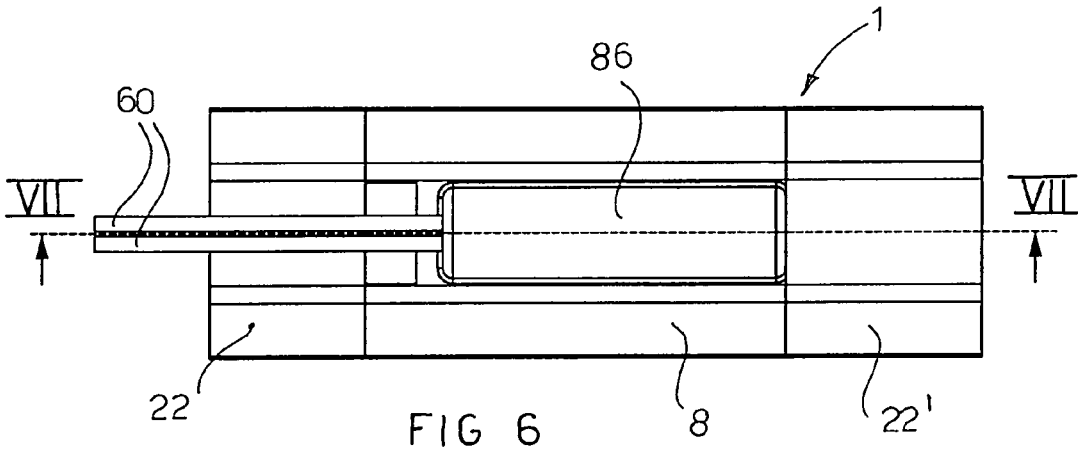
Figure 7:
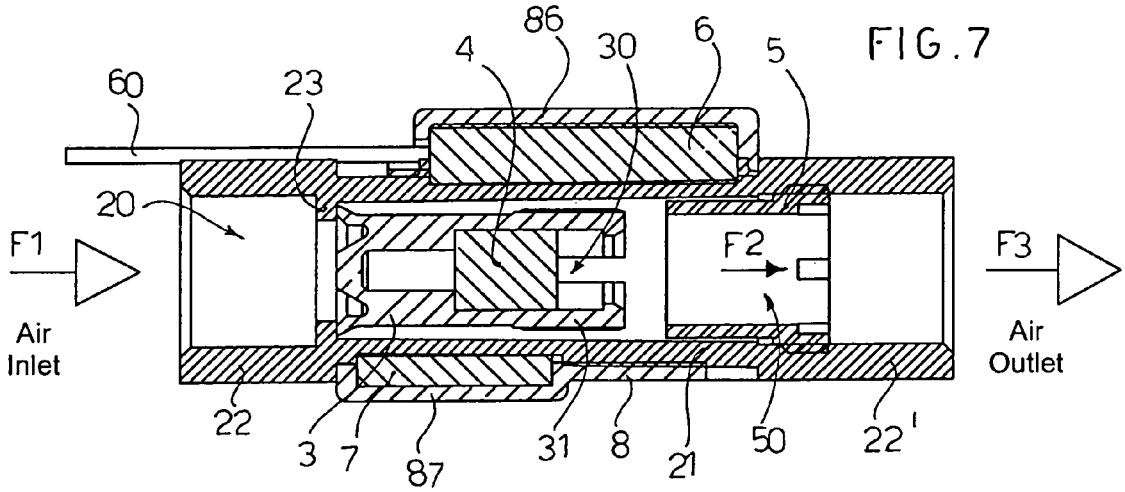
Figure 8:
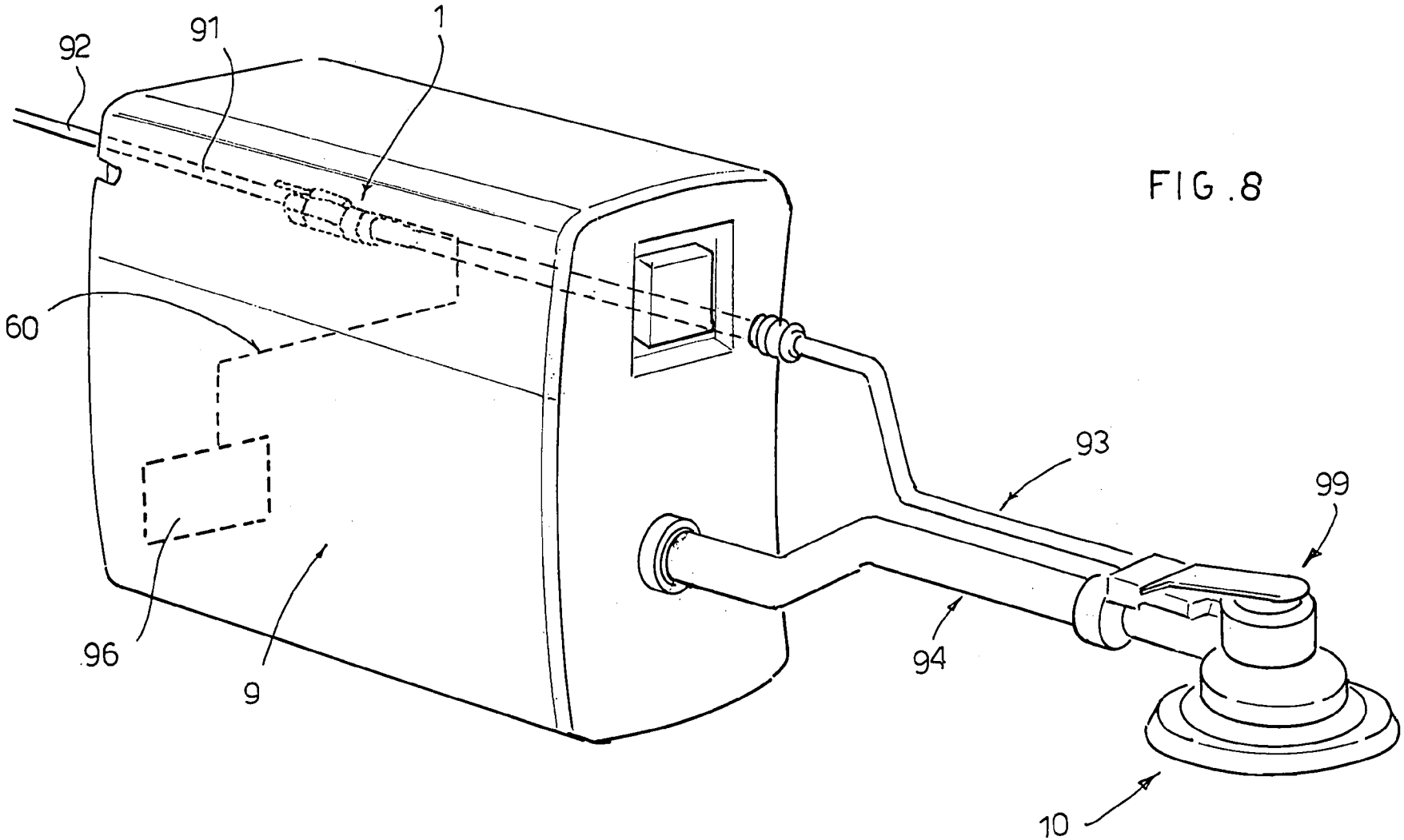
Figure 10:
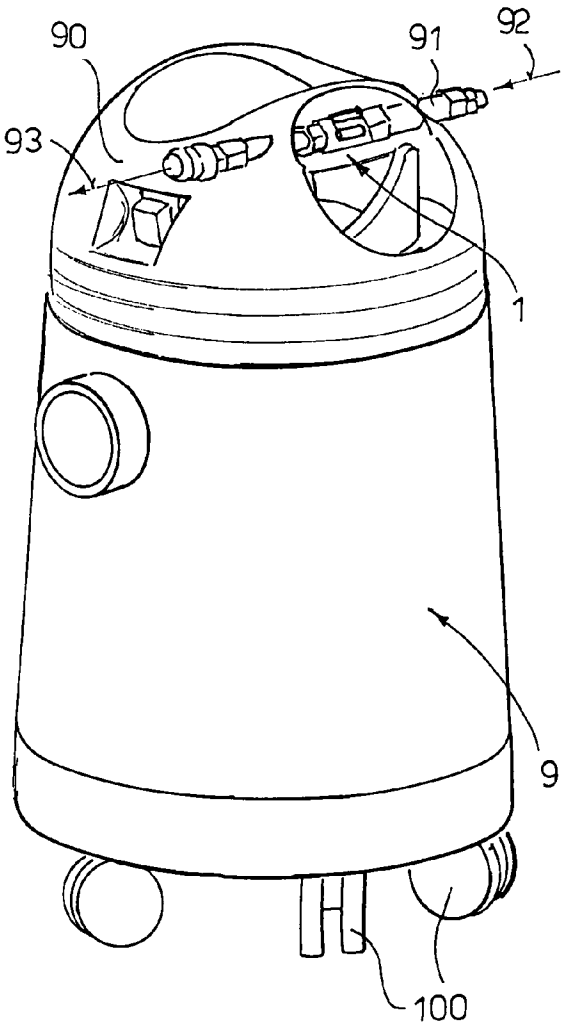
Figure 9:
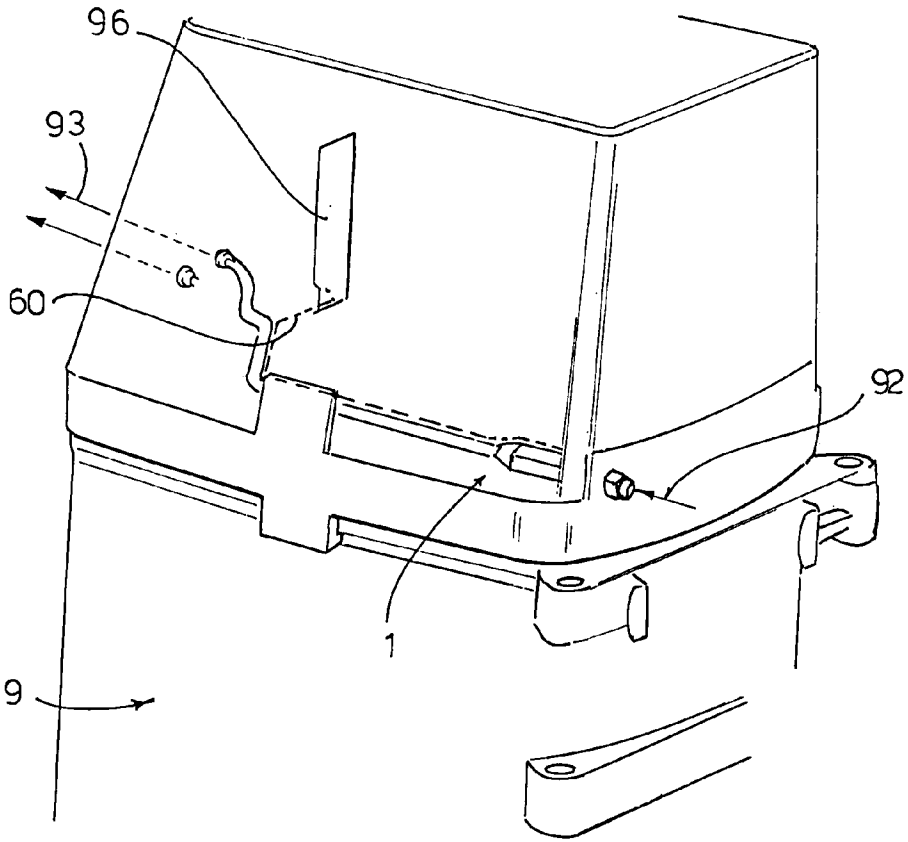

Further characteristics of the invention will appear clearer from the detailed description that follows, referring to one of its embodiments purely by way of example and therefore in a non-limitative manner, illustrated in the attached drawings, where:

FIG. 1 is an exploded perspective view illustrating the various elements that constitute the flow switch in accordance with the invention, FIG. 2 is a perspective view of the assembled flow switch in FIG. 1 (assembled without protective jacket), FIG. 3 is a side view illustrating the assembled flow switch in FIG. 2, FIG. 4 is a view from the rear end of the flow switch in the direction of arrow A in FIG. 3, in which some parts are partially shown in section, FIG. 5 is a view from the front end of the flow switch in the direction of arrow B in FIG. 3, FIG. 6 is a plan view from above of the flow switch in FIG. 3, FIG. 7 is an axial cross-section view taken along sectional plane VII—VII in FIG. 6, FIG. 8 is a perspective schematic view illustrating the utilization of the flow switch in accordance with the invention in an aspirator connected to a grinding machine, FIG. 9 is a perspective view, partially cut off, illustrating a parallelepipedal aspirator, and FIG. 10 is a perspective view of a cylindrical aspirator on castors.

The flow switch in accordance with the invention, indicated in its entirety by reference number 1, will now be described with the aid of FIGS. 1–7.

The flow switch 1 includes an internally hollow body 2, provided with a substantially cylindrical axial through chamber 20. The body 2 of the flow switch includes a central portion having a cylindrical outer lateral surface 21 located between two end portions 22 and 22' having a hexagonal nut shape suitable for coupling with a type "20" hexagonal wrench. The hexagonal shape of the end portions 22, 22' has been specially chosen to allow the flow switch 1 to be housed within an aspirator of the type commonly available on the market.

For clarity, the front hexagonal portion, that is to say the portion at the fluid inlet part, is indicated by 22 and the rear hexagonal portion, at the fluid outlet part, by 22'. Thus, in the following, the terms front and rear refer respectively to the inlet part and outlet part of the fluid passing through the flow switch.

As shown in FIG. 7, a front end-of-stroke collar 23 is provided in the front part of the chamber 20 of the flow switch body, the collar projecting radially in the internal direction to create an abutment surface and thus a narrowing of the axial chamber 20.

The flow switch 1 also includes a substantially cylindrical sleeve or shuttle 3 having an external diameter slightly smaller than the internal diameter of the body 2 in order to axially slide within the chamber 20 of the body 2. The shuttle 3 is open at one end and has an axial cylindrical seat 30. The other end of the shuttle 3 is closed.

Retaining teeth 31 are provided on the seat 30 of the shuttle 3 in the form of longitudinal elastic tongues that can bend outwards and elastically return to their original position. The retaining tongues 31 project slightly outwards with respect to the body of the shuttle, which has a smaller diameter than that of the chamber 20 of the flow switch's body 2.

The flow switch 1 includes a magnet 4 made of a material that is magnetically attractive and at the same time suitable for exciting a magnetic field. The magnet 4 can be made of ferrite, for example.

The magnet 4 has a substantially cylindrical shape with an external diameter equal to the internal diameter of the seat 30 of the shuttle. In this way, the magnet 4 can be inserted in the seat 30 of the shuttle causing the elastic yielding of the retaining tongues 31, which spring back into the original position and restrain the magnet 4 in position.

The flow switch 1 includes a substantially cylindrical rear end-stop bushing 5. The bushing 5 is hollow inside and has an axial through chamber 50. The bushing 5 has an external diameter substantially equal to the internal diameter of the body 2, so that it can be inserted into the chamber 20 of the body 2 and locked in position via interference coupling or press-fitting or other fixing systems, such as threaded coupling, welding or gluing.

In this way, as shown in FIG. 7, the shuttle 3 lies inside the axial chamber 20 of the flow switch's body between the collar 23 and the bushing 5 that respectively function as abutments and front and rear end-of-stroke for the shuttle 3. The fixing position of the bushing 5 and the length of the shuttle 3 are designed in a manner to ensure that the shuttle 3 has approximately 3.5 mm of travel from a front position in which the shuttle 3 is in abutment against the collar 23 and a rear position in which the shuttle is in abutment against the bushing 5.

The body 1, the shuttle 3 and the bushing 5 are preferably made of the same type of hard plastic material, such as acetal resin for example, and can be made by injection moulding.

The flow switch 1 includes a magnetic contact switch 6, commonly known and commercially available as a Reed switch. The Reed switch 6 is connected to electrical conductor cables 60 destined to be connected to an electronic circuit board.

The Reed switch 6 is able to detect a magnetic field generated by the movement of the excitation magnet 4. When it detects this magnetic field, the Reed switch 6 closes an electric circuit and sends a control signal to the electronic circuit board via the electric cables 60.

The flow switch 1 includes three magnets 7 able to generate a field of magnetic attraction suitable for attracting the excitation magnet 4. The attraction magnets 7 can have an elongated cylindrical shape and be made of AlNiCo V (Aluminium-Nichel-Cobalt alloys).

Finally, the flow switch 1 includes an internally hollow protective rubber jacket 8, having an axial cylindrical chamber 80 with an internal diameter substantially equal to the external diameter of the central portion 21 of the flow switch's body. The jacket 8 has a hexagonal outer lateral surface with a cross-section profile substantially equal to that of the hexagonal end portions 22 and 22' of the body 2.

A semi-cylindrical seat 86 suitable for holding the Reed switch 6 and three semi-cylindrical seats 87 suitable for holding the three attraction magnets 7 are obtained on the outer lateral walls of the jacket 8. The seats 86 and 87 communicate with the axial chamber 80 of the jacket 8. In this way, when the jacket 8 is fitted over the central part 21 of the flow switch's body 2, the Reed switch 6 and the three attraction magnets 7 are in contact with the outer lateral surface of the central part 21 of the flow switch's body 2.

As is better shown in FIGS. 4 and 5, the seats 86 and 87 of the jacket 8 are arranged in such a way that one of the three attraction magnets 7 is located in a diametrically opposed position with respect to the Reed switch 6 and the other two attraction magnets 7 are arranged at angular distance of 60° on one side and on the other with respect to the central magnet. In this way, the three magnets 7 are arranged on the lateral surface of the central part 21 of the flow switch's body 2 within an arc of a circle subtended by an angle of approximately 120°.

In addition, the Reed switch 6 is arranged with one of its ends close to the rear hexagonal portion 22' of the body 2. The three magnets 7 are arranged, instead, with one of their ends close to the front hexagonal portion 22 of the body 2.

Preferably, the Reed switch 6 and the three magnets 7 are arranged in the correct position on the central part 21 of the flow switch's body 2 and the rubber jacket 8 is moulded on the central part 21 of the body, so as to incorporate the Reed switch 6 and the three magnets 7. In this case, the Reed switch 6 and the three magnets 7 can be glued in the correct position on the central part 21 of the flow switch's body 2 or directly inserted in the mould that will create the body of the flow switch so that they will integrally adhere to the central part 21 of the flow switch's body 2 with them arranged in the correct position.

The operation of the flow switch 1 in accordance with the invention is now described, with particular reference to FIG. 7. In the initial condition, the attraction magnets 7 exert a field of magnetic attraction that acts upon the excitation magnet 4 placed inside the shuttle 3. In consequence, the shuttle 3 finds itself in its front end-of-stroke position in abutment against the front collar 23.

When a flow of fluid enters the chamber 20 of the body from the front portion 22, in the direction of the F1 arrow, this fluid passes through the collar 23 and strikes the front wall of the shuttle 3. As a result, the shuttle 3 is pushed backwards by the flow of fluid against the action of the field of magnetic retention generated by the attraction magnets 7. Therefore, the shuttle moves backwards until it abuts against the rear end-of-stroke bushing 5.

The movement of the excitation magnet 4 that is placed inside the shuttle 3 generates a magnetic field that excites the Reed switch 6. In consequence, the Reed switch sends a control signal to an electronic circuit board via the electric cables 60.

During flow delivery, the fluid passes peripherally with respect to the shuttle 3, between the shuttle's outer lateral surface and the internal surface of the body 2 and therefore passes axially within the chamber 50 of the bushing 5 in the direction of the F2 arrow and finally exits from the rear portion 22' in the direction of the F3 arrow.

The moment in which the fluid feed is interrupted, the field of magnetic attraction generated by the magnets 7 attracts the excitation magnet 4 and the shuttle 30 therefore returns to its initial front position in contact against the front collar 23. In this way, the shuttle 3 is ready to signal a new delivery of fluid.

It should be noted that the return of the shuttle 3 to the initial position is always assured by the field of magnetic retention generated by the magnets 7, irrespectively of the position of the flow switch 1. In this way, the flow switch in accordance with the invention can operate in any position and is particularly suited for mounting on portable equipment destined to be moved about.

Even though specific reference has been made in the figures to three attraction magnets 7 with an elongated cylindrical shape and arranged in a particular position, it is clearly evident that the invention also extends to a single attraction magnet of any shape or to any number of attraction magnets arranged in any position on the outer surface of the body 2.

With reference to FIG. 8, a possible application of the flow switch 1 in an aspirator 9 is now described. The flow switch 1 is mounted in the head 90 of the aspirator, arranged horizontally so as to intercept an air feed pipe 91 of the aspirator. The air feed pipe 91 is connected to an air supply pipe 92 arriving from a pneumatic system and to a delivery pipe 93 connected to a pneumatic machine, such as a grinding machine 10.

The grinding machine 10 is connected, in turn, to an air suction pipe 94 running to the compressor or turbine 95 of the aspirator 9 for sucking the dust created by the grinding machine. The grinding machine 10 has a start-stop button 99 on the top.

The Reed switch of the flow switch 1 is connected by electric cables 60 to an electronic circuit board 96 of the aspirator's control unit that controls the starting of the aspirator's compressor 95.

In this way, when the operator starts the grinding machine 10 by pressing the start button 99, a flow of air arrives from the pneumatic system, through the supply pipe 92, the pipe 91 of the aspirator and the delivery pipe 93, which starts operation of the grinding machine 10. This airflow passes through the flow switch 1, causing the displacement of the flow switch's shuttle and the Reed switch becomes excited and sends a control signal to the electronic circuit board 96, which controls the starting of the compressor 95 of the aspirator 9. Consequently, the dust created by the grinding machine 10 is aspirated by the suction pipe 94.

When the grinding machine 10 is switched off, the airflow no longer passes through the feed pipe 91 of the aspirator. In consequence, the flow switch's shuttle is attracted by the magnets 7 to the initial position, so as to prepare the flow switch for another switching on of the aspirator 9.

An aspirator 9 having a substantially parallelepiped shape, mounted on wheels to facilitate moving it to the desired position, is illustrated in FIG. 9.

A flow switch 1 in accordance with the invention is mounted in the head of the aspirator in FIG. 9. As can be noted in the figure, the aspirator has two outlets for connecting two delivery pipes 93 for two grinding machines.

FIG. 10 illustrates an aspirator 9 with a substantially cylindrical shape, mounted on castors 100 for moving it to the desired position. A flow switch 1 in accordance with the invention is mounted in the head of the aspirator in FIG. 11.

It should be taken in to consideration that the aspirators in FIGS. 9 and 10 can be rotated or upturned as desired in any position whilst always guaranteeing operation of the flow switch 1 in accordance with the invention.

Numerous variations and detail changes within the reach of a person skilled in the art can be made to this embodiment, these nevertheless falling within the scope of the invention expressed by the attached claims.

The invention claimed is:

1. A magnetic flow switch comprising:

a body defining a substantially cylindrical, axial through chamber destined to have a flow of fluid pass through the chamber, an excitation magnet arranged in a shuttle mounted in said chamber of the body in a manner such that shuttle can slide, passing from an initial front position to a final rear position, under the effect of the pressure of the fluid flow running through the chamber of the flow switch, a magnetic contact switch arranged on the flow switch's body to detect a magnetic field generated by a displacement of said excitation magnet from the front position to the rear position and to accordingly send a control signal to an electronic control board, and at least one attraction magnet arranged on the body of the flow switch, in a position such as to generate an attraction magnetic field able to attract said excitation magnet to make the shuttle move to the initial front position when the fluid flow is interrupted, irrespective of the position in which the flow switch is located.

2. A flow switch of claim 1, wherein said magnetic contact switch is positioned close to a rear part of the flow switch and said at least one attraction magnet is positioned close to a front part of the flow switch.

3. A flow switch of claim 1, wherein the switch includes three attraction magnets.

4. A flow switch of claim 3, wherein one of said attraction magnets is arranged in a diametrically opposed position with respect to the magnetic contact switch and the other two attraction magnets are arranged at angular distance of approximately 60° on one side and the other with respect to the central attraction magnet.

5. A flow switch of claim 1, wherein said at least one attraction magnet has a substantially elongated cylindrical shape.

6. A flow switch of claim 1, wherein said at least one attraction magnet is made of AlNiCo V.

7. A flow switch of claim 1, wherein said excitation magnet is made of ferrite.

8. A flow switch of claim 1, wherein said body includes:

a central portion having a cylindrical outer lateral surface upon which said magnetic contact switch and said at least one attraction magnet are arranged, and two front and rear end portions with a hexagonal nut shape.

9. A flow switch of claim 8, wherein said body includes a protective jacket arranged on a central part of the body so as to cover said magnetic contact switch and said at least one attraction magnet.

10. A flow switch of claim 9, wherein said protective jacket is made of rubber.

11. A flow switch of claim 1, wherein said body includes:

a front collar radially protruding towards the inside of the body in the chamber to form a front end-of-stroke abutment for the shuttle, and a rear bushing suitable for being fixed within the front part of the chamber of the body to form a rear end-of-stroke abutment for the shuttle.

12. A flow switch of claim 11, wherein at least one of the body, the shuttle or the bushing is made of acetal resin for injection moulding.

13. A flow switch (1) of claim 1, wherein said shuttle has a substantially cylindrical shape and includes a seat able to accept said excitation magnet and at least one of retaining teeth and tongues able to lock the excitation magnet in position against a seat of the shuttle.

14. A flow switch of claim 1, wherein said shuttle has a stroke of approximately 3.5 mm from the initial front position to the final rear position.

15. A flow switch of claim 1, wherein said flow switch is installed in an aspirator.

16. A flow switch of claim 15, wherein said aspirator is suitable for being connected to a pneumatic machine.

17. A pneumatic machine connected to an aspirator incorporating the flow switch according to claim 1.

* * * * *